US008800633B2

(12) United States Patent
Mullet et al.

(10) Patent No.: US 8,800,633 B2
(45) Date of Patent: Aug. 12, 2014

(54) ANTI-REVERSIBLE POWER SPRING APPARATUS AND METHOD

(75) Inventors: Willis Jay Mullet, Gulf Breeze, FL (US); Christopher Lee Wysoczynski, Gulf Breeze, FL (US); Darrin W. Brunk, Pensacola, FL (US); Richard Scott Hand, Pace, FL (US)

(73) Assignee: Qmotion Incorporated, Pensacola, FL (US)

( * ) Notice: Subject to any disclaimer, the term of this patent is extended or adjusted under 35 U.S.C. 154(b) by 284 days.

(21) Appl. No.: 12/799,879

(22) Filed: May 4, 2010

(65) Prior Publication Data

US 2011/0272106 A1 Nov. 10, 2011

(51) Int. Cl.
*E06B 9/56* (2006.01)

(52) U.S. Cl.
USPC ..... 160/317; 160/318

(58) Field of Classification Search
USPC ..... 160/310, 313, 318, 309, 315, 325, 326, 160/170, 323.1, 317; 185/45, 37; 242/375
See application file for complete search history.

(56) References Cited

U.S. PATENT DOCUMENTS

| | | | | | |
|---|---|---|---|---|---|
| 179,319 | A * | 6/1876 | Johnson | 160/306 |
| 481,733 | A * | 8/1892 | Perkins | 160/318 |
| 504,970 | A * | 9/1893 | Dennis | 160/318 |
| 1,298,716 | A * | 4/1919 | Hoover | 185/45 |
| 1,575,695 | A * | 3/1926 | La Rue | 185/45 |
| 2,188,824 | A * | 1/1940 | Thigpen | 446/260 |
| 2,243,780 | A * | 5/1941 | Thigpen | 185/45 |
| 4,009,745 | A | 3/1977 | Erpenbeck | |
| 5,799,716 | A * | 9/1998 | Yamaguchi et al. | 160/310 |
| 6,283,192 | B1 | 9/2001 | Toti | |
| 6,648,050 | B1 | 11/2003 | Toti | |
| 6,659,156 | B2 | 12/2003 | Wen et al. | |
| 6,854,503 | B2 | 2/2005 | Cross et al. | |
| 6,957,683 | B2 | 10/2005 | Toti | |
| 7,717,156 | B2 * | 5/2010 | Costello et al. | 160/317 |
| 2006/0137837 | A1 * | 6/2006 | Costello et al. | 160/317 |
| 2008/0121353 | A1 * | 5/2008 | Detmer et al. | 160/266 |
| 2008/0289777 | A1 * | 11/2008 | Costello et al. | 160/317 |

* cited by examiner

*Primary Examiner* — David Purol
(74) *Attorney, Agent, or Firm* — Zarley Law Firm, P.L.C.

(57) ABSTRACT

In a shade system with a bracket supporting a shade storage roll, an anti-reversible power spring apparatus includes at least one biasing system connected with the storage roll wherein the biasing system includes a biasing member with a first end and a second end wherein the first end moves with the storage roll as the storage roll rotates and wherein the second end is held stationary with reference to the storage roll when the storage roll rotates in one direction but not when the storage roll rotates in a second direction. A support for the at least one biasing system is provided wherein the support includes a protrusion that holds the second end against movement when the storage roll is rotated in the one direction but which allows passage of the second end past the protrusion when the storage roll is rotated in the second direction.

20 Claims, 4 Drawing Sheets

ANTI-REVERSIBLE POWER SPRING APPARATUS AND METHOD

FIELD OF THE INVENTION

This invention relates to shade systems and mechanisms and methods for assisting in the movement of the shade system. In particular, in accordance with one embodiment, the invention relates, in a shade system with a bracket supporting a shade storage roll, to an anti-reversible power spring apparatus including at least one biasing system connected with the storage roll wherein the biasing system includes a biasing member with a first end and a second end wherein the first end moves with the storage roll as the storage roll rotates and wherein the second end is held stationary with reference to the storage roll when the storage roll rotates in one direction but not when the storage roll rotates in a second direction. A support for the at least one biasing system is provided wherein the support includes a protrusion that holds the second end against movement when the storage roll is rotated in the one direction but which allows passage of the second end past the protrusion when the storage roll is rotated in the second direction.

BACKGROUND OF THE INVENTION

A difficulty arises with the operation of shades for windows, doors and the like. In particular, shade systems include shade rolls to which the shade is attached. The shade is rolled onto the shade roll and dispensed from the roll and taken up by the roll as required. A major difficulty is caused by the requirements to keep the shade system small enough to not be obtrusive and to fit in the window or door space while still enabling the easy operation and movement of the shade. Motors are utilized to assist the movement of the shade but the weight of the shade can require very large, noisy motors.

Prior art devices abound that provide assistance to motors and to the operation of shade systems. In particular, roll type shades, curtains, and doors can be counterbalanced as has been known in the art. In Erpenbeck, U.S. Pat. No. 4,009,745, a window shade support roller having an improved spring motor construction and method of manufacture includes a spring retaining structure which holds a driving spring and a spear structure having an integral spear. The spear structure and the spring retaining structure cooperate together, and with a ball, to form a ball clutch mechanism. The spring retaining structure has ball-receiving recesses with canting floors which simplify assembly. Assembly steps include inserting balls into the spring retaining structure, inserting the spear structure into the spring retaining structure, inserting a dowel into the spear structure, positioning a spring around the dowel, and inserting one end of such spring between portions of the spring retaining structure, which uniquely capture and retain the end without other securement, for torsional winding of the spring. However this device must be mounted horizontally so gravity can move the balls in the channel of the ratchet surface arrangement. If the device is mounted vertically, such that there is no force from gravity the balls will not move in the channel.

In U.S. Pat. Nos. 6,283,192 and 6,957,683 to Toti, a spring drive system for window covers is disclosed which includes a so-called flat spring drive and the combination whose elements are selected from a group which includes (1) a band transmission which provides varying ratio power transfer as the cover is opened and closed; (2) a gear system selected from various gear sets which provide frictional holding force and fixed power transfer ratios; and (3) a gear transmission which provides fixed ratio power transfer as the cover is opened or closed. The combination permits the spring drive force at the cover to be tailored to the weight and/or compression characteristics of the window cover such as a horizontal slat or pleated or box blind as the cover is opened and closed. This art discusses the use of multiple drums with flat type springs but does not address the issue of possible back winding the spring.

In U.S. Pat. No. 6,648,050 to Toti, a spring drive system useful for window covers is disclosed, which comprises one or more coil spring drives or flat spring drives and the combination whose elements are selected from one or more of a group which includes (1) a band or cord transmission which provides varying ratio power transfer as the cover is opened and closed; (2) gear means comprising various gear sets which provide frictional holding force and fixed power transfer ratios; (3) a gear transmission which provides fixed ratio power transfer as the cover is opened or closed; (4) crank mechanisms; (5) brake mechanisms; and (6) recoiler mechanisms. The combination permits the spring drive force to be tailored to the weight and/or compression characteristics of an associated window cover such as a horizontal slat or pleated or box blind as the cover is opened and closed.

In U.S. Pat. No. 6,659,156 to Wen et al., a screw transmission mechanism for a motor-driven blind is constructed to include a driving unit, and at least one cord roll-up unit controlled by the driving unit to lift/lower or tilt the slats of the motor-driven Venetian blind. Each cord roll-up unit includes an amplitude modulation set controlled by the driving unit to lift/lower the slats and bottom rail of the Venetian blind, a frequency modulation set for rotation with the amplitude modulation set to tilt the slats of the Venetian blind, and a linkage adapted to control connection between the frequency modulation set and the amplitude modulation set.

In U.S. Pat. No. 6,854,503 to Cross et al., the invention includes an unbalanced horizontal blind with a spring means to provide a lifting or retraction force for the slats of the blinds. A brake means prevents undesired movement of the slats that would otherwise result from the continuous retraction force of the spring means when the slats are set in a desired position. Controls for the release of the brake means and tilting are also provided in an embodiment of a blind of the invention. An embodiment of the invention permits the blind to be operated by a single wand that can be used to either raise the slats or tilt the slats. This eliminates the need for a loose cord or bead chain that would traditionally be used as the user interface for controlling the movement of the slats of the blind.

Despite these efforts, the art is still missing a counter balancing system that is easily adjustable such that counter balances may be added or deleted as the circumstances require and as they change. That is, all the prior art of which applicants are aware are fixed systems or complex adjustable systems that are bulky and hard to manipulate. At best prior art systems can accommodate small adjustments but major changes in the weight of the shade to be moved require total replacement of existing counter balances.

Another missing element in the prior art is a simple system for the prevention of back winding of the counter balance springs. For example, if some element of a prior art system was changed, like a battery or batteries, and then the shade was rehung partially deployed, this can result in a reverse wind of the counter balance spring when the motor moves the shade up to the fully open position. This is not desirable since it can, and often does, damage the counter balance systems in the prior art.

Thus, it is an object of this invention to provide a counter balance system and method that is modular and that is easy to install and adjust. Further it is an objective of the invention to provide a counter balance system that does not back wind and can not back wind during operation of a shade system.

SUMMARY OF THE INVENTION

Accordingly, according to one embodiment in a shade system with a bracket supporting a shade storage roll, an anti-reversible power spring apparatus consists of at least one biasing system connected with the storage roll wherein the biasing system includes a biasing member with a first end and a second end wherein the first end moves with the storage roll as the storage roll rotates and wherein the second end is held stationary with reference to the storage roll when the storage roll rotates in one direction but not when the storage roll rotates in a second direction. A support is provided for the at least one biasing system wherein the support includes a protrusion that holds the second end against movement when the storage roll is rotated in the one direction but which allows passage of the second end past the protrusion when the storage roll is rotated in the second direction.

Another aspect of the invention further includes a housing connected to the storage roll such that the housing moves with the storage roll and wherein the biasing member fits within the housing and the first end of the biasing member is connected to the housing. In one aspect the invention further includes more than one biasing member. In another aspect, the storage roll includes a motor connected to the storage roll such that the motor moves with the storage roll. In a further aspect, the biasing member is a spring and in another the spring is a coiled, flat spring.

In one aspect, the housing is comprised of two parts such that the housing may be opened up and biasing members added or removed and then the two parts reconnected and the housing closed. In another aspect, the support for the biasing system is connected with the bracket and wherein the storage roll may move but the bracket and the support do not move. In another aspect, the housing includes depressions on the outside of the housing conformed to receive the first end of the biasing member from the inside of the housing and to hold the first end in place in the depressions on the outside of the housing.

According to another embodiment, in a shade system with a bracket supporting a shade storage roll, an anti-reversible power spring apparatus consists of a storage roll with a hollow interior and at least one longitudinal groove in the interior. A housing with at least one protrusion on the outside of the housing is conformed to engage the groove in the interior of the storage roll, the protrusion connecting the housing with the storage roll such that the housing moves with the storage roll and wherein the housing is comprised of two halves such that the housing may be opened up and biasing members added or removed from the inside of the housing and then the two halves reconnected and the housing closed. At least one biasing member is provided within the housing wherein the biasing member includes a first end and a second end wherein the first end is connected with the housing and moves with the housing as the storage roll rotates and wherein the second end is held stationary with reference to the storage roll when the storage roll rotates in one direction but not when the storage roll rotates in a second direction. And a support for the at least one biasing member and the housing wherein the support is connected with the bracket and does not move when the storage roll moves and wherein the support includes a protrusion that holds the second end of the biasing member against movement when the storage roll is rotated in the one direction but which allows passage of the second end past the protrusion when the storage roll is rotated in the second direction.

In another aspect, the invention further includes more than one biasing member. In one aspect, the biasing member is a spring and in another aspect the spring is a coiled, flat spring. In one aspect, the bracket is fixed in place to a surface the storage roll may move but the bracket does not move. In a further aspect, the invention further includes a motor assembly, the motor assembly with protrusions on the outside of the motor assembly, the protrusions conformed to engage said longitudinal grooves, and the motor assembly includes a motor out put shaft wherein the motor assembly is connected to the storage roll inside the storage roll by the protrusions and moves with the storage roll and wherein the out put shaft is connected with the support and does not move with the storage roll.

In one aspect, the housing includes depressions on the outside of the housing conformed to receive the first end of the biasing member from the inside of the housing and to hold the first end in place in the depression on the outside of the housing.

According to another embodiment of the invention, in a shade system with a bracket supporting a shade storage role, an anti-reversible power spring method consists of the steps of:

a. providing a storage roll with a hollow interior and at least one longitudinal groove in the interior; a housing with at least one protrusion on the outside of the housing conformed to engage the groove in the interior of the storage roll, the protrusion connecting the housing with the storage roll such that the housing moves with the storage roll and wherein the housing is comprised of two halves such that the housing may be opened up and biasing members added or removed from the inside of the housing and then the two halves reconnected and the housing closed; at least one biasing member within the housing wherein the biasing member includes a first end and a second end wherein the first end is connected with the housing and moves with the housing as the storage roll rotates and wherein the second end is held stationary with reference to the storage roll when the storage roll rotates in one direction but not when the storage roll rotates in a second direction; and a support for the at least one biasing member and the housing wherein the support is connected with the bracket and does not move when the storage roll moves and wherein the support includes a protrusion that holds the second end of the biasing member against movement when the storage roll is rotated in the one direction but which allows passage of the second end past the protrusion when the storage roll is rotated in the second direction; and b. moving the storage roll.

In another aspect, the method further includes the step of opening the housing and adding or removing a biasing member and then closing the housing. In a further aspect, the biasing member is a spring and in another aspect the spring is a coiled, flat spring.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
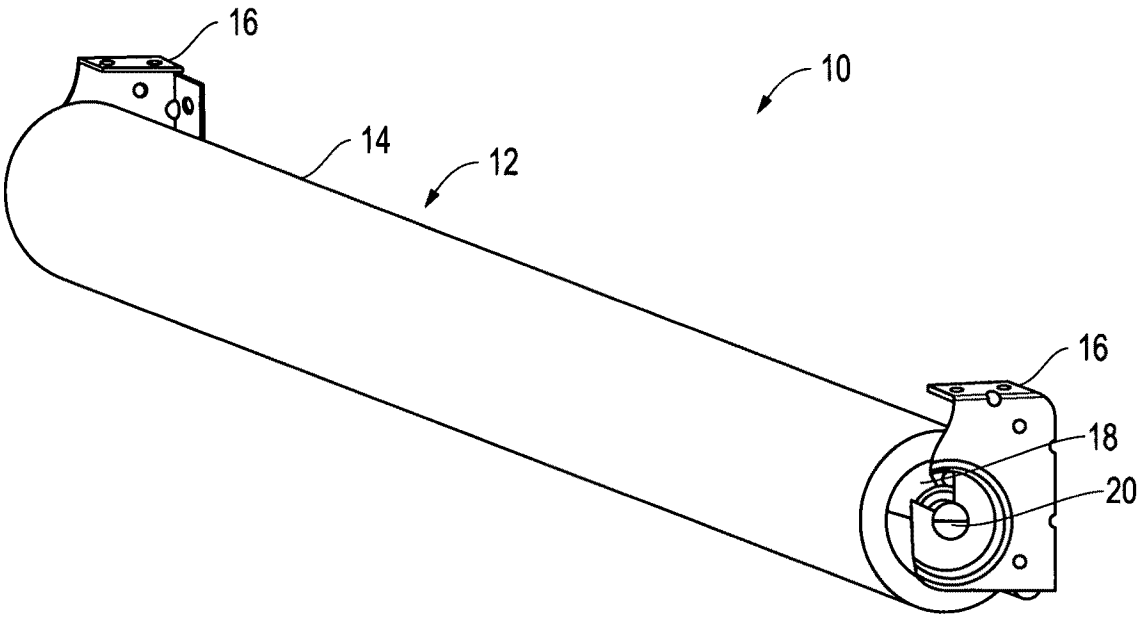
FIG. 1 is a perspective view of a shade roll and bracket assembly for the anti-reversible power spring apparatus of the present invention according to one embodiment.

The preferred embodiment of the present invention is illustrated by way of example in FIGS. 1-5. With specific reference to FIG. 1, the preferred embodiment of the anti-reversible power spring apparatus 10 of the present invention includes an associated roll shade assembly 12, consisting of a shade material 14, mounting bracket 16, a storage roll 18 and at least one arbor shaft or support 20. The shade material 14 is attached to the storage roll 18 as is known in the art. As used herein, the term "shade material" is used in its common manner to indicate a substance used to provide shade. It thus includes fabric and plastic, for example only and not by way of limitation, and any other flexible material now known or hereafter developed capable of being rolled onto and off of a storage roll.

Figure 2:
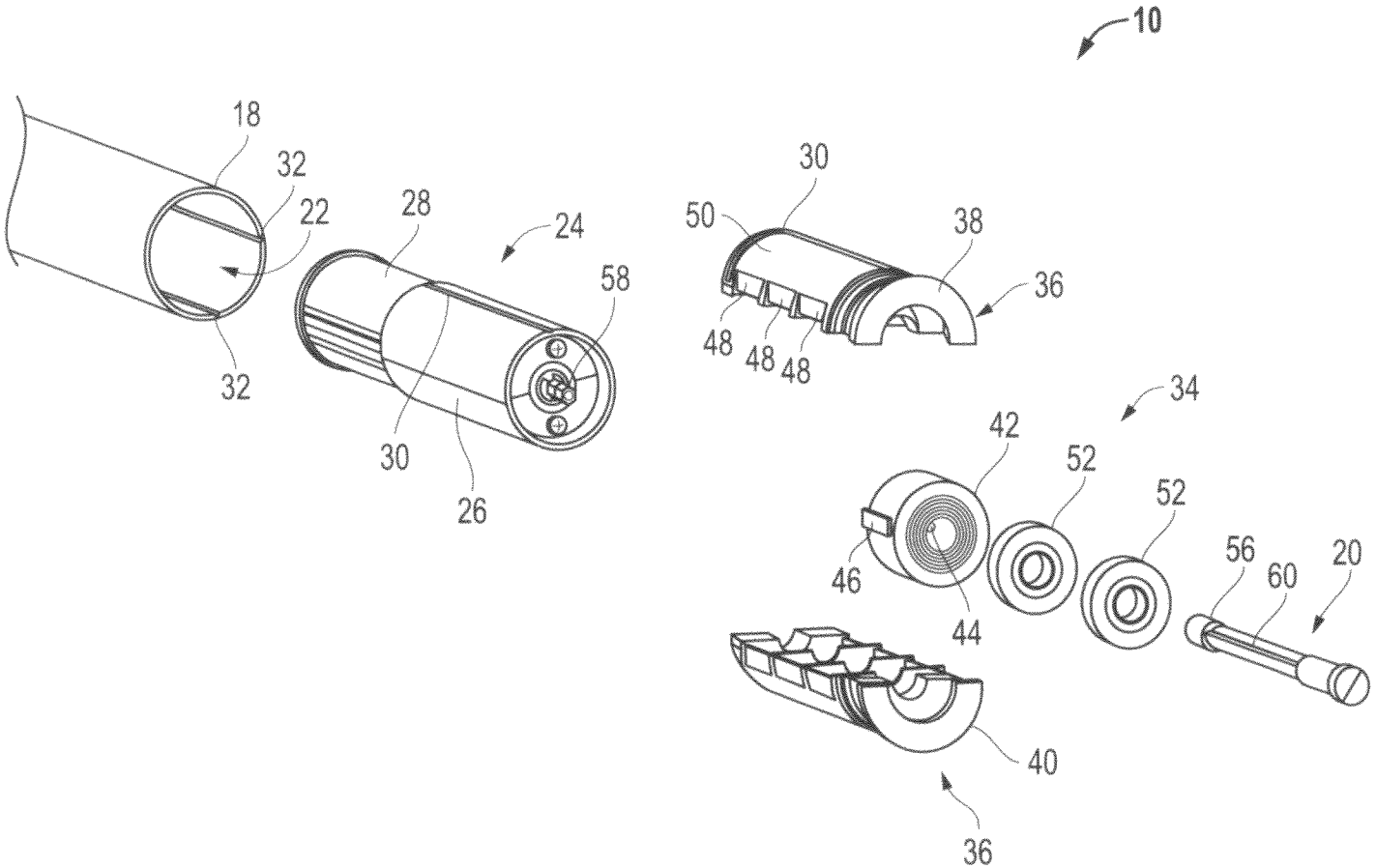
FIG. 2 is an exploded perspective view of the invention of FIG. 1 showing the biasing assembly and one biasing member.
Figure 3:
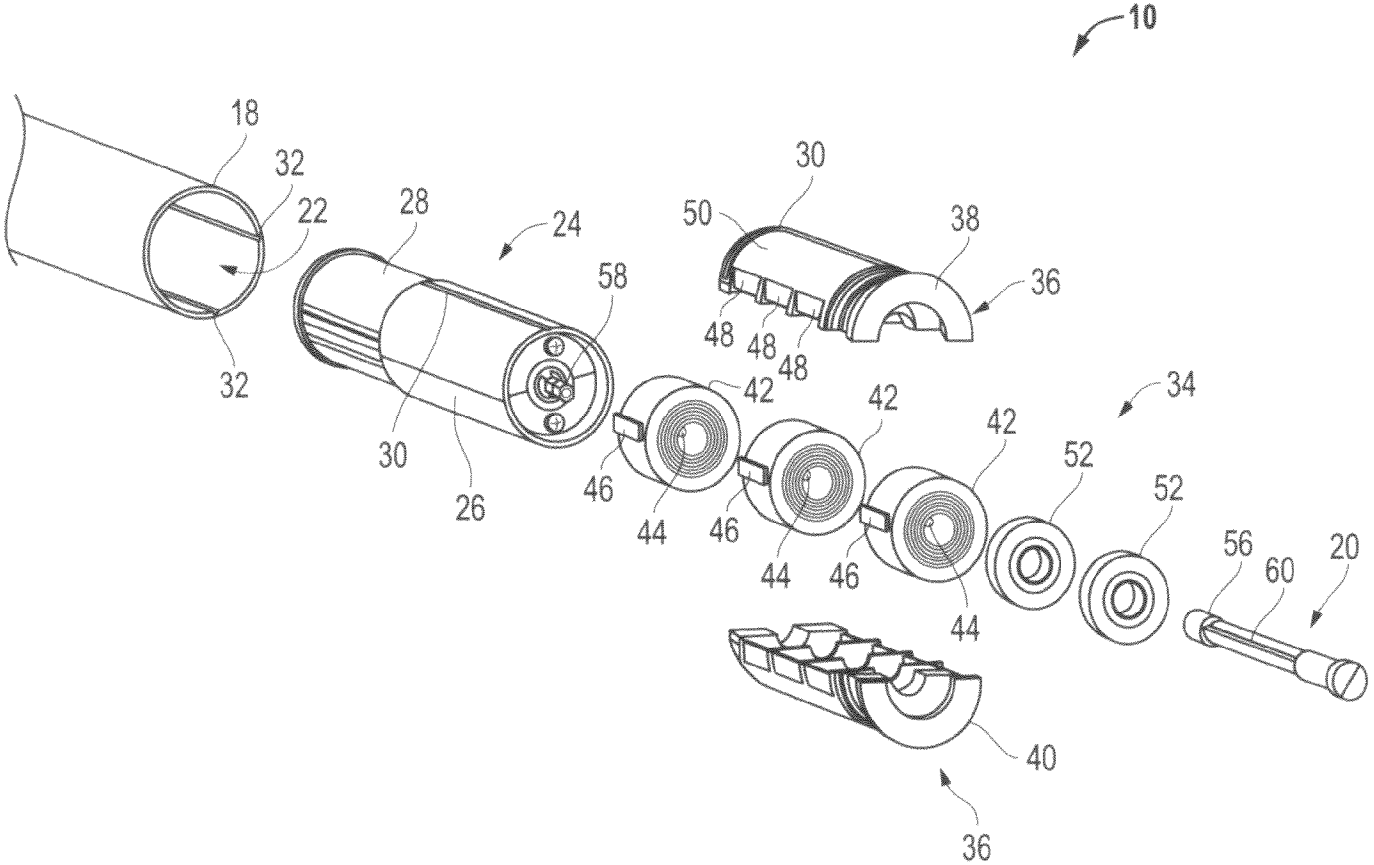
FIG. 3 is an exploded perspective view of the invention of FIG. 1 showing the biasing assembly and three biasing members.

Referring now to FIGS. 2 and 3, the inside the storage roll 18, according to a preferred embodiment is hollow. It thus is capable of including within the hollow interior 22 many mechanisms such as, for example only, a motor assembly 24, including a motor 26 and gearbox 28. The motor assembly 24 has one or more protrusions 30, a spline or ridge as shown, that mate with an internal longitudinal groove(s) 32 in the interior surface of the hollow interior 22 of storage roll 18. The figures show two longitudinal grooves 32 but there may be more or less. The effect of inserting motor assembly 24 within the hollow interior 22 of storage roll 18, by aligning the protrusions 30 with the longitudinal groove(s) 32, is to lock the two elements together such that the motor assembly 24 turns with the storage roll 18.

Figure 4:
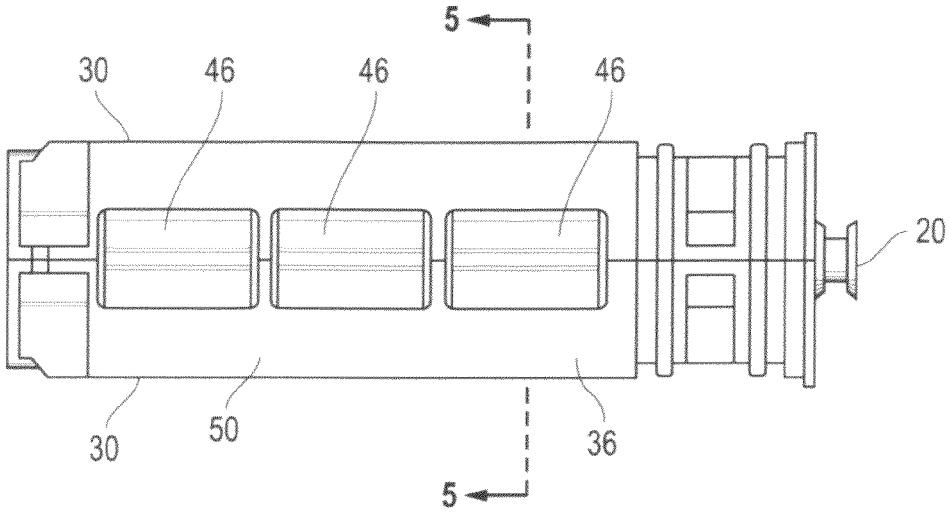
FIG. 4 is a side view of the biasing assembly.
Figure 5:
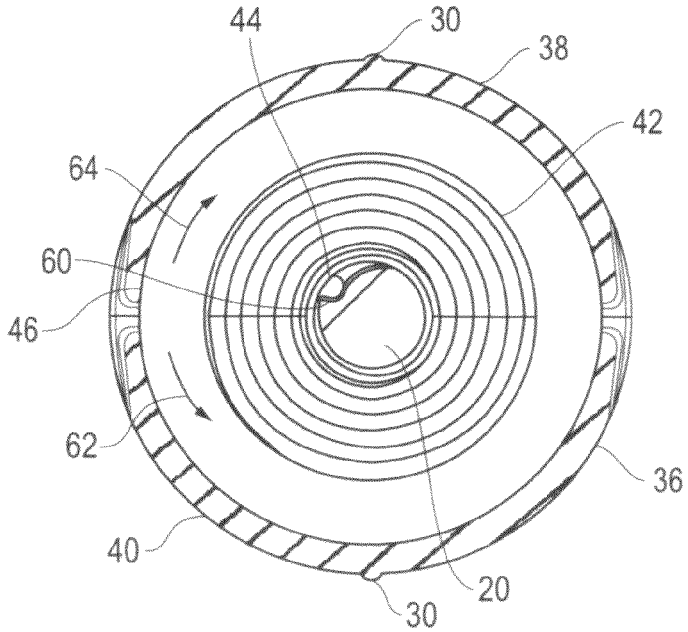
FIG. 5 is a section view along lines 5-5 of FIG. 4 of the biasing assembly.

Referring now to FIGS. 2, 3 and 4, in a preferred embodiment, a biasing system 34 consists of a housing 36. Preferably again, housing 36 consists of two housing halves 38 and 40. The two housing halves 38 and 40 have protrusions 30, similar to if not identical to the protrusions 30 on the motor assembly 24, that also mate with the internal longitudinal grooves 32 in the storage roll 18 such that the housing 36, consisting of housing halves 38 and 40, turns with the storage roll 18.

The housing 36, halves 38 and 40, is constructed to contain at least one biasing member 42. The biasing member 42, or members, has a first stationary end 44 and a second rotating end 46. The second rotating end 46 of the biasing member 42, or members, is, according to a preferred embodiment, secured to the housing half 38 by fixing its location in the depression or depressions 48 in the outside surface 50 of housing 36. The applicants have determined that a preferred embodiment has provisions for three biasing members 42 as illustrated in FIGS. 2, 3 and 4 but it is anticipated the more or less may be used.

The housing 36, halves 38 and 40, is also constructed, preferably, to contain at least one bearing surface 52. The bearing surface 52, or bearing surfaces 52 as illustrated, support an arbor or support 20. Bearing surfaces 52 may be, but are of course not limited to, ball or roller bearings. The arbor or support 20 is fixed from rotation by fixed connection to the mounting bracket 16 (as shown in FIG. 1). Arbor or support 20 supports the bearing surfaces 52 and biasing members 42. The end 56 of the arbor or support 20 has a receptacle or key that mates with motor 26 output shaft 58 of the motor 26 such that the output shaft 58 is stationary to the mounting bracket 16.

The arbor or support 20 also has a shaped protrusion 60 extending along the length of the biasing member 42 as illustrated. The first stationary end 44 of the biasing member 42 engages the shaped protrusion 60, as more clearly shown in FIG. 5, of the arbor or support 20 when the storage roll 18 and the housing 36, halves 38 and 40, are rotated by movement of the storage roll 18 either manually or mechanically in one direction, the tensioning direction shown by direction arrow 62 in FIG. 5. Importantly, however, the first end 44 "ramps" or passes over the shaped protrusion 60 when the storage roll 18 and the housing 36 are rotated in the opposite direction in the direction of direction arrow 64 in FIG. 5. This unique feature of the present invention prevents damage to the biasing system 34 and the motor 26, when present, as is almost certain to happen when back winding occurs in prior art devices as discussed above. Further, when the biasing member 42 is in tension by being rotated in the direction of direction arrow 62, a spring contracts and assists in securing the first stationary end 44 with the shaped protrusion 60 on the arbor or support 20.

In this regard, according to a preferred embodiment, biasing member 42 is a spring as illustrated and, preferably again, a coiled flat spring has been found by the applicants to be very suitable for the purposes of the present invention. Among other things, coiled flat spring's torque is a function of material thickness and width. In this embodiment the springs of the biasing member 42 are designed for the tallest curtain or shade such that the same spring can be used for all shorter applications and, however, in accordance with the present invention where the biasing members 42 can be added and removed as needed. That is, by way of the present invention a predetermined maximum torque and maximum turns of biasing member 42 can be created. Then, individual biasing members 42 can be identified, by number or color or any other useful system, such that a user may construct a power spring combination suitable for use as a counter balance for any weight of shade and any shade system.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In a shade system with a bracket supporting a shade storage roll, an anti-reversible power spring apparatus comprising:

at least one biasing system connected with the storage roll wherein the biasing system includes a biasing member with a first end and a second end wherein the second end moves with the storage roll as the storage roll rotates and wherein the first end is held stationary with reference to the storage roll when the storage roll rotates in one direction but not when the storage roll rotates in a second direction;

a support for the at least one biasing system wherein the support includes a protrusion that holds the first end against movement when the storage roll is rotated in the one direction but which allows passage of the first end over and past the protrusion when the storage roll is rotated in the second direction; and a housing slidably connected with the storage roll such that the connection permits the housing to move along a length of the storage roll while at the same time the connection secures the housing in place within the storage roll as the storage roll rotates and wherein the biasing member is in the housing.

2. The apparatus of claim 1 wherein the biasing member fits within the housing and the first end of the biasing member is connected to the housing.

3. The apparatus of claim 1 further including more than one biasing member.

4. The apparatus of claim 1 wherein the storage roll includes a motor connected to the storage roll such that the motor moves with the storage roll.

5. The apparatus of claim 1 wherein the biasing member is a spring.

6. The apparatus of claim 5 wherein the spring is a coiled, flat spring.

7. The apparatus of claim 2 wherein the housing is comprised of two parts such that the housing may be opened up and the biasing member added or removed and then the two parts reconnected and the housing closed.

8. The apparatus of claim 1 wherein the support for the biasing system is connected with the bracket and wherein the storage roll may move but the bracket and the support do not move.

9. The apparatus of claim 2 wherein the housing includes depressions on the outside of the housing conformed to receive the second end of the biasing member from the inside of the housing and to hold the second end in place in the depressions on the outside of the housing.

10. In a shade system with a bracket supporting a shade storage roll, an anti-reversible power spring apparatus comprising:

a storage roll with a hollow interior and at least one longitudinal feature in the interior of the storage roll;

a housing with at least one feature on the outside of the housing conformed to engage the longitudinal feature in the interior of the storage roll the feature connecting the housing with the storage roll such that the housing is free to move along the longitudinal feature but the connection of the feature and the longitudinal feature causes the housing to move with the storage roll as the storage roll rotates and wherein the housing is comprised of two halves such that the housing may be opened up and biasing members added or removed from the inside of the housing and then the two halves reconnected and the housing closed;

at least one biasing member within the housing wherein the biasing member includes a first end and a second end wherein the second end is connected with the housing and moves with the housing as the storage roll rotates and wherein the first end is held stationary with reference to the storage roll when the storage roll rotates in one direction but not when the storage roll rotates in a second direction; and a support for the at least one biasing member and the housing wherein the support is connected with the bracket and does not move when the storage roll moves and wherein the support includes a protrusion that holds the first end of the biasing member against movement when the storage roll is rotated in the one direction but which allows passage of the first end over and past the protrusion when the storage roll is rotated in the second direction.

11. The apparatus of claim 10 further including more than one biasing member.

12. The apparatus of claim 10 wherein the biasing member is a spring.

13. The apparatus of claim 12 wherein the spring is a coiled, flat spring.

14. The apparatus of claim 10 wherein when the bracket is fixed in place to a surface the storage roll may move but the bracket does not move.

15. The apparatus of claim 10 further including a motor assembly the motor assembly having features on the outside of the motor assembly the features conformed to engage the longitudinal features and the motor assembly including a motor output shaft wherein the motor assembly is connected to the storage roll inside the storage roll by the features and moves with the storage roll and wherein the out put shaft is connected with the support and does not move with the storage roll.

16. The apparatus of claim 10 wherein the housing includes depressions on the outside of the housing conformed to receive the first end of the biasing member from the inside of the housing and to hold the first end in place in the depression on the outside of the housing.

17. In a shade system with a bracket supporting a shade storage roll, an anti-reversible power spring method comprising:

providing a storage roll with a hollow interior and at least one longitudinal feature in the interior; a housing with at least one feature on the outside of the housing conformed to engage the longitudinal feature in the interior of the storage roll the feature connecting the housing with the storage roll such that the housing is free to move along a length of the longitudinal feature but the connection of the feature and the longitudinal feature causes the housing to move with the storage roll and wherein the housing is comprised of two halves such that the housing may be opened up and biasing members added or removed from the inside of the housing and then the two halves reconnected and the housing closed; at least one biasing member within the housing wherein the biasing member includes a first end and a second end wherein the second end is connected with the housing and moves with the housing as the storage roll rotates and wherein the first end is held stationary with reference to the storage roll when the storage roll rotates in one direction but not when the storage roll rotates in a second direction; and a support for the at least one biasing member and the housing wherein the support is connected with the bracket and does not move when the storage roll moves and wherein the support includes a protrusion that holds the first end of the biasing member against movement when the storage roll is rotated in the one direction but which allows passage of the first end over and past the protrusion when the storage roll is rotated in the second direction; and moving the storage roll.

18. The method of claim 17 further including the step of opening the housing and adding or removing a biasing member and then closing the housing.

19. The method of claim 17 wherein the biasing member is a spring.

20. The method of claim 19 wherein the spring is a coiled, flat spring.

* * * * *